US006068283A

United States Patent [19]

Couderc et al.

[11] Patent Number: 6,068,283

[45] Date of Patent: May 30, 2000

[54] DEVICE FOR ADJUSTING THE POSITION OF A BINDING ON A GLIDE BOARD, ESPECIALLY A SNOWBOARD

[75] Inventors: Bernard Couderc, Annecy; Joel Bourdeau, Saint-Jorioz, both of France

[73] Assignee: Salomon S.A., Metz-Tessy, France

[21] Appl. No.: 08/956,591

[22] Filed: Oct. 23, 1997

[30] Foreign Application Priority Data

Oct. 25, 1996 [FR] France ..... 96 13157

[51] Int. Cl.[7] ..... A63C 9/02

[52] U.S. Cl. ..... 280/618; 280/633; 280/14.2

[58] Field of Search ..... 280/14.2, 607, 280/617, 618–623, 630, 633, 634

[56] References Cited

U.S. PATENT DOCUMENTS

| | | | |
|---|---|---|---|
| 5,044,654 | 9/1991 | Meyer | 280/613 |
| 5,236,216 | 8/1993 | Ratzek | 280/607 |
| 5,261,689 | 11/1993 | Carpenter et al. | 280/618 |
| 5,520,406 | 5/1996 | Anderson et al. | 280/624 |
| 5,544,909 | 8/1996 | Laughlin et al. | 280/617 |
| 5,584,492 | 12/1996 | Fardie | 280/14.2 |
| 5,667,237 | 9/1997 | Lauer | 280/607 |
| 5,732,959 | 3/1998 | Soejima | 280/14.2 |
| 5,791,678 | 8/1998 | Perlman | 280/618 |

FOREIGN PATENT DOCUMENTS

| | | |
|---|---|---|
| 0285558 | 10/1988 | European Pat. Off. . |
| 3-1977 | 1/1991 | Japan . |

*Primary Examiner*—J. J. Swann
*Assistant Examiner*—David R. Dunn
*Attorney, Agent, or Firm*—Greenblum & Bernstein, P.L.C.

[57] ABSTRACT

A device for adjusting the position of a binding on a glide board. The device includes a base plate equipped with an orifice and an edge of the orifice includes a first peripheral surface portion; a disc having a contour that exceeds that of the orifice and including an edge that has a second surface portion adapted to come into contact with the first surface portion when the disc gets nested in the orifice; an anchoring device of the disc on the board that can be actuated by tightening so as maintain contact between the surface portions, wherein at least one of the surface portions is substantially smooth and constitutes a sliding ramp for the other surface portion, and wherein the device includes a rotational stop of the base plate in an engagement position when the anchoring device is are actuated by tightening, and able to become disengaged when the anchoring device is are only partially loosened, thus allowing a rotational movement of the base plate with respect to disc. The invention facilitates the adjustment of the angular position of a binding on the glide board.

10 Claims, 6 Drawing Sheets

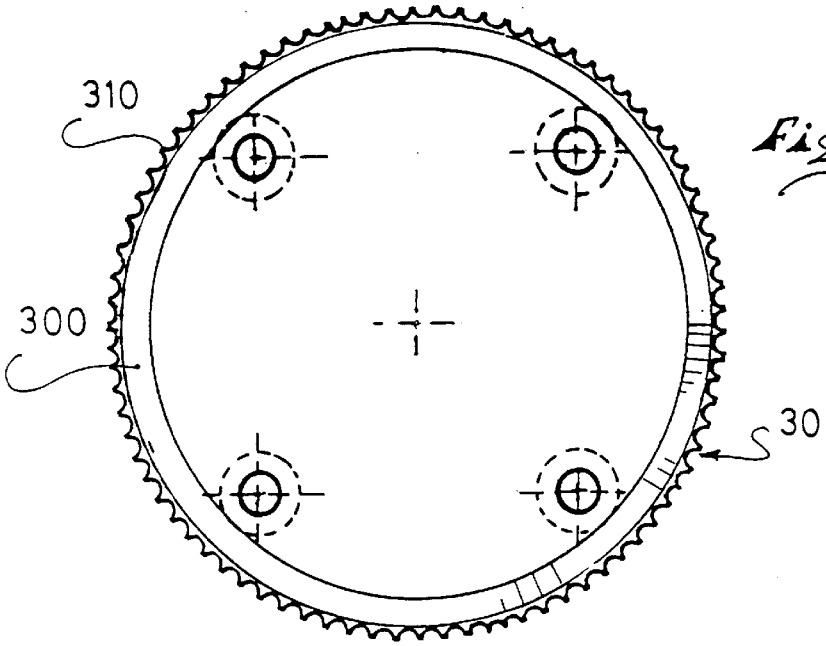
Fig: 3
Fig: 4
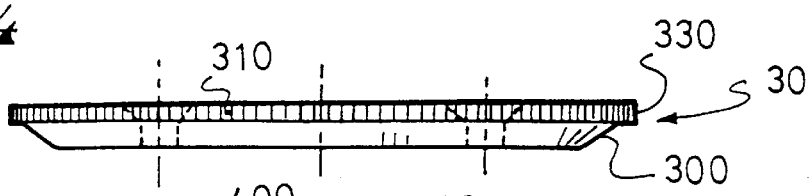
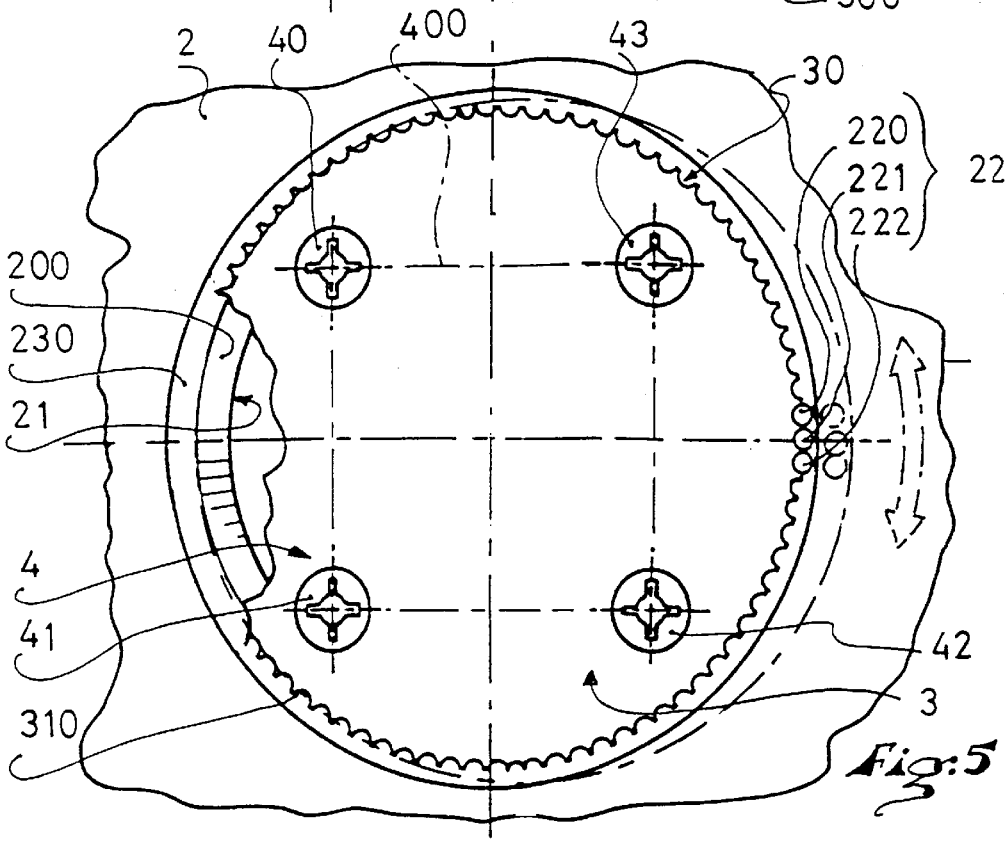
Fig: 5

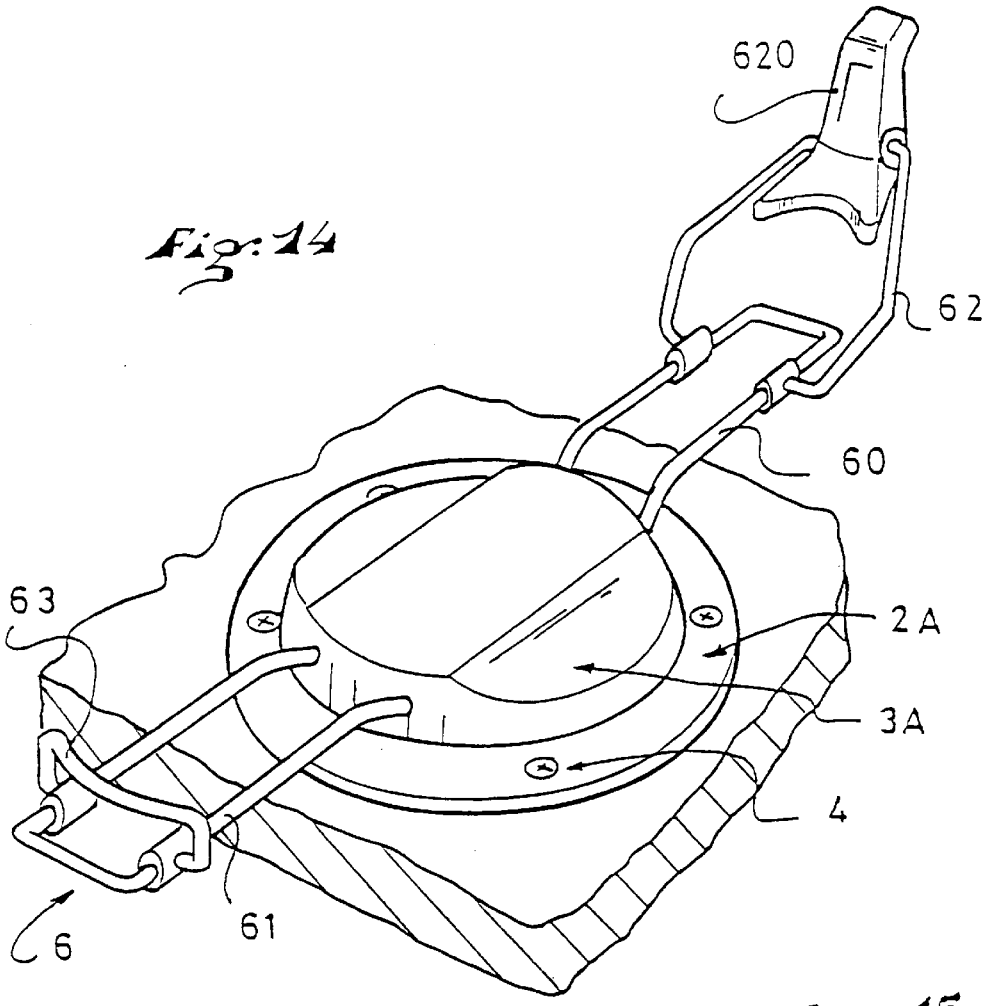
Fig: 14
Fig: 15
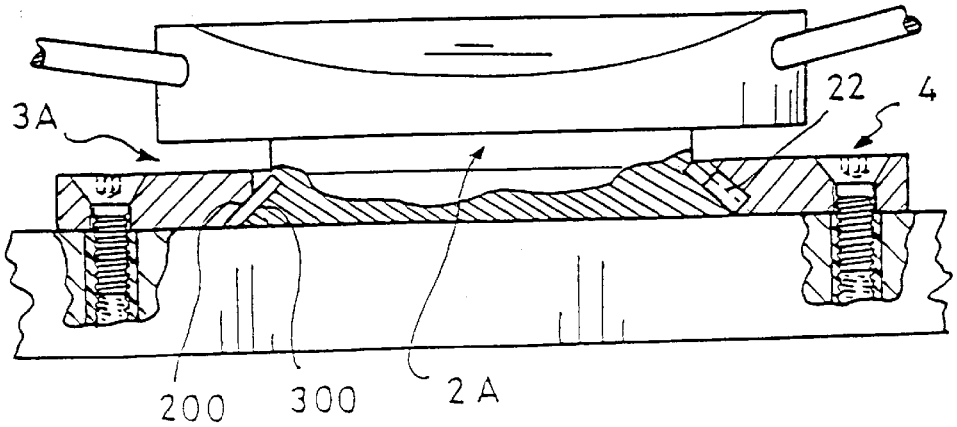

DEVICE FOR ADJUSTING THE POSITION OF A BINDING ON A GLIDE BOARD, ESPECIALLY A SNOWBOARD

BACKGROUND OF THE INVENTION

1. Field of the Invention

The invention is related to systems for binding a boot on a board and it is related more specifically to the field of snowboarding. It is related to a device enabling the adjustment of the angular position of a binding on a board, especially a snowboard.

2. Description of Background and Relevant Information

Snowboarding is performed with the use of an elongated board on which both feet of a user are immobilized via appropriate retention elements. The positions that are adopted for practicing this sport can be extremely varied. The feet are generally inclined at about several dozen degrees with respect to the median longitudinal axis of the board.

In order to allow an angular adjustment to be made that is adapted to the user's requirements, the most widespread system consists of providing a device that comprises a base plate having an elongate shape equipped with means to receive and affix a boot comprising a central hole in which a disc is housed, the disc being anchored directly in the board by means of several screws that maintain the plate in position on the board by taking support on the edge of the central hole.

U.S. Pat. No. 5,261,689 provides an example of such a binding device that is adapted to receive a flexible snowboarding boot. In this particular case, the disc is equipped with a truncated edge comprising a plurality of radial striations that form a mesh with a plurality of striations, having a complementary shape, of a truncated edge of the central hole of the plate. The bass plate is adjusted by unscrewing the affix screws of the disc and by rotationally displacing the plate by the desired angle. One of the problems encountered in this practice has its origins in gravity, i.e., the disc remains nested and automatically centered in the hole of the base plate. Thus, the meshing of the striations is maintained and this creates a substantial friction force that resists the rotation of the plate during the manual adjustment thereof. Consequently, adjustment is done jerkily and this makes it more difficult to locate the desire angular position.

Furthermore, successive adjustments tend to cause a premature wear and tear of the striations and can result in reduced retention during the rotation of the base plate. Most of the time, the disc must eventually be entirely unscrewed so as to allow the vertical lifting of the disc and enable the rotation of the plate with respect to the disc; this makes the adjustment operation both long and pain staking.

U.S. Pat. No. 5,236,216 is related to a similar device in which the disc comprises a circumferential edge that forms, in conjunction with the edge of a central hole of the base plate, an annular support surface that is circumscribed within a substantially horizontal or parallel plane with respect to the plane of the board. This support surface comprises surface roughnesses or fine serrations so as to adequately secure the base plate by friction. This device is easier to adjust but it cannot ensure an efficient automatic centering of the disc in the hole, nor any substantial rotational resistance due to the planar configuration of the support surface.

The utility design JP-(U)-3001977 is related to a snowboard binding comprising a base plate that is bored with an assembly hole for a disc that is designed so as to be able to get nested in the hole along a smooth support surface having a truncated shape. An independent and offset blocking device equipped with a latch is provided on the side of the base plate in order to latch the base plate with respect to the board. However, this device is not entirely satisfactory either since it is necessary to use an additional disc located between the base plate and the board that comprises housings for positioning the latch. Most importantly, the presence of such a disc creates an over elevation of the boot with respect to the board; this is not very desirable since one needs to retain an adequate perception of sensations vis-a-vis the board.

A binding device known as "Clicker" is available commercially and is distributed by the Shimano company. This device comprises a base plate equipped with a hole for receiving a central disc of a complementary shape that gets nested therein. The disc comprises serrations located along the periphery of the disc edge that get engaged in a plurality of vertical pions located at the periphery of the disc along an edge of the base plate. A dozen or so pions are spaced at a few degrees from one another and distributed along an extensive portion of the perimeter of the edge of the approximately 180° central hole; this does not allow for an easy disengagement of the disc in order to make an angular adjustment.

In addition, the nesting of the trough shaped disc in the hole of the base plate does not allow the disc to slide with respect to the base plate. In order to change the orientation of the plate with respect to the disc, the anchoring screws of the disc must be almost entirely unscrewed so as to be able to raise it enough vertically in order to disengage the serrations and pions forming the rotational stop. The vertical raising of the disc is not practical and generally requires the use of a screw driver that must act as a lever. In addition, this state must be maintained during the entire angular adjustment operation.

SUMMARY OF THE INVENTION

It is therefore an object of the invention to provide a device for the rotational adjustment of a base plate with respect to a blocking disc that will provide a satisfactory solution to the problems encountered in prior art devices.

In particular, according to the instant invention, the base plate that generally bears the boot can be more easily displaced rotationally while the anchoring device of the disc are only partially loosened. The adjustment operation is thus much more rapid. The adjustment can be made with greater continuity and without jerky displacements of the base plate, thus allowing for a more precise and efficient adjustment.

Finally, the device according to the invention does not have elements exposed to friction that can generate wear and tear problems and influence the functioning the device.

To this end, the invention is related to a position adjustment device for a binding on a glide board, especially a snowboard, including:

- a base plate adapted to receive a boot; the plate being equipped with a circular orifice and whose edge comprises a first peripheral surface portion;
- a central disc having a contour that exceeds that of the circular orifice and comprising a peripheral edge that has a second surface portion adapted to come into contact with the first surface portion when the disc gets nested in the orifice of the base plate;
- an arrangement for anchoring the central disc on the board that can be actuated by tightening so as to retain a firm contact between the surface portions without any possibility of rotational movement of the base plate with respect to the disc;

wherein at least one of the surface portions constitutes a sliding ramp for the other surface portion, and wherein the device includes, in addition, a rotational stop device of the base plate with respect to the central disc, in an engagement position when the anchoring arrangement is actuated by tightening, and apt to get disengaged, by the sliding of the surface portions on the ramp formed by the other, and the off-centering of the central disc with respect to the orifice of the plate when the anchoring arrangement is only partially loosened, thus allowing a rotational movement of the base plate with respect to the central disc.

The invention can also include a base plate that is directly connected to the board via anchoring arrangement whereas it is the central disc that is rotationally mobile with respect to the base plate. This inverse example can also enter within the scope established by the invention.

In a preferred manner, both surface portions have a complementary substantially conical shape. This improves the contact of the disc on the plate; which in turn favors both the sliding during the off-centering of the disc as well as the return-to-center of the disc.

According to another characteristic of the invention, the anchoring arrangement is constituted by several screws passing through the hole distributed along the central disc and adapted to become anchored in the glide board. The partial loosening of the screws allows the disc to get off-centered with respect to the orifice of the base plate by the lateral displacement of the base plate, which causes the central disc to be inclined. Thus, by a simple off-centering of the disc with respect to the base plate, a disengagement of the stop device, and thus freedom of rotational movement of the base plate is obtained.

According to a preferred characteristic of the invention, the surface portions that are in contact on one another have a slope with respect to the general plane of the base plate, such slope being comprised between 25 and 45 degrees, and preferably comprised between 30 and 35 degrees (inclusive of the limit values). These values were chosen so that the function of the automatic centering of the disc in the orifice of the base plate could be retained, and at the same time, the sliding of the disc to cause an off-centering during a rotational adjustment of the base plate could be encouraged.

BRIEF DESCRIPTION OF THE DRAWINGS

Other characteristics and advantages of the invention will be better understood with the help of the description that follows, with reference to the annexed drawings that illustrate non-restrictive examples of the invention.

FIG. 3 is a top view of the central disc alone according to the device of the invention;

FIG. 4 is a side view of the central disc alone according to the device of the invention;

FIG. 5 is a top detailed view of FIG. 2;

FIG. 14 is a perspective view of a device according to another variation of the invention; and FIG. 15 is a sectional view of the device as illustrated in FIG. 14.

DETAILED DESCRIPTION OF THE PREFERRED EMBODIMENTS

Figure 1:
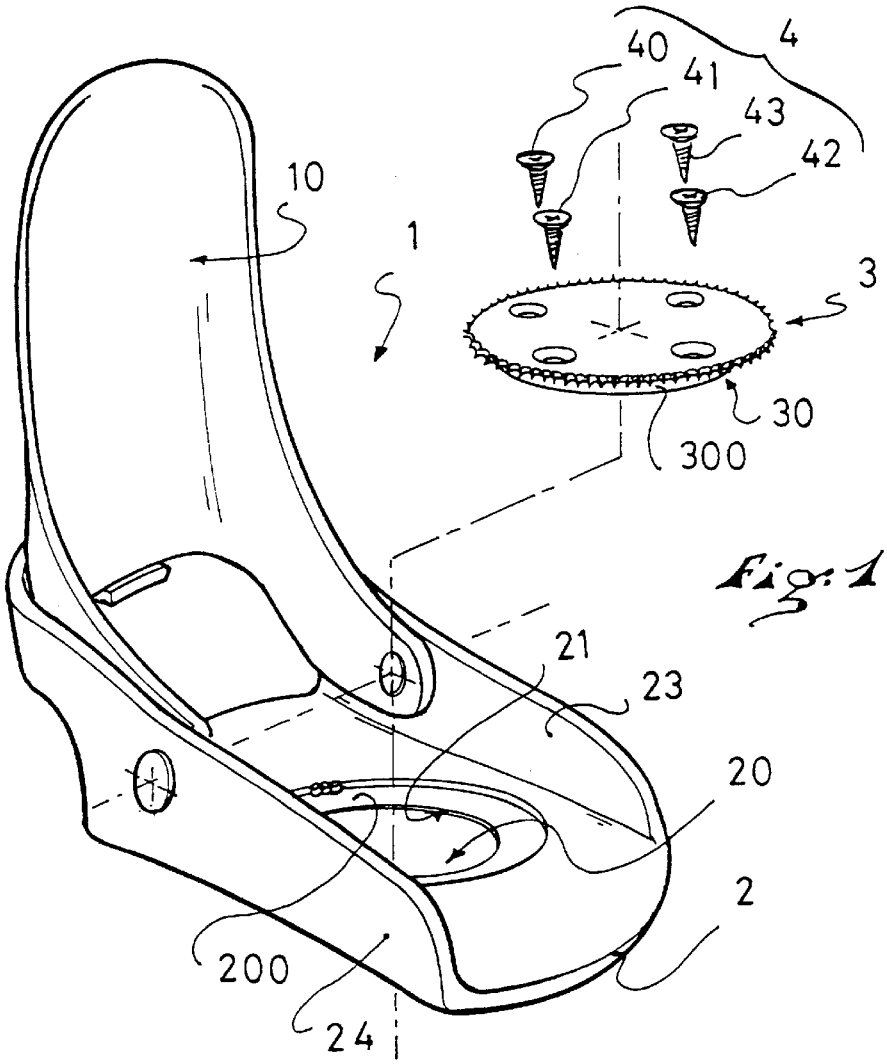
FIG. 1 is a perspective mew of the device according to the invention before assembly of the disc on the base plate.
Figure 2:
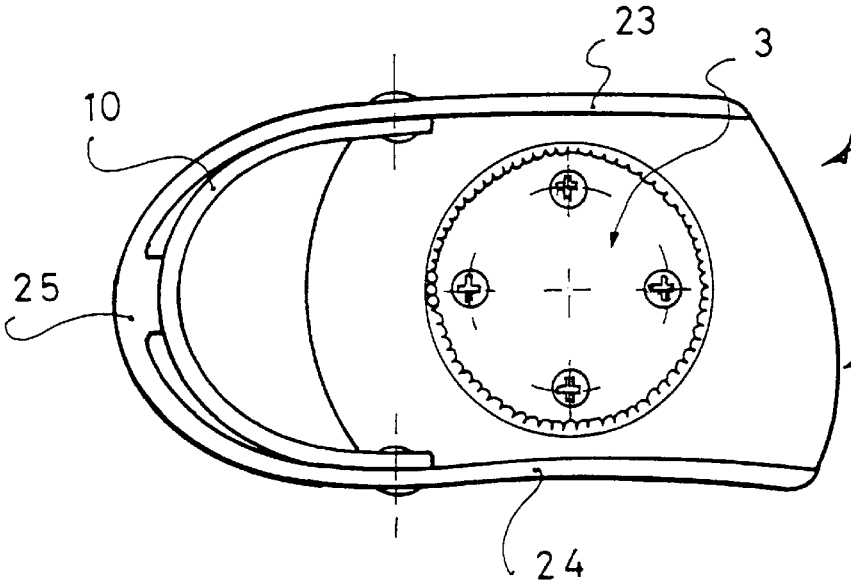
FIG. 2 is a top view of the device of the invention as per FIG. 1.

Now, with reference to the details of the drawings, FIGS. 1 and 2 represent a device according to the invention that comprises, for a better understanding of the invention, only a portion of the binding elements of a snowboard adapted for flexible boots.

According to the example illustrated, the device 1 comprises a base plate 2 that is adapted to rest on the upper surface of a board (not represented) along an orientation that is variable with respect to the median longitudinal axis of the board, and is generally substantially transverse with respect to the axis. The plate can comprise lateral walls 23, 24 that extend substantially vertically for the lateral maintenance of the boot. These walls act as supports for the anchoring of the boot binding means, which are, generally, known means such as straps and latches with catches (not represented). The walls come together towards the rear of the device by an incurved wall for the heel 25, acting as a support to a rear support element 10 that is journalled on the lateral walls 23, 24.

The dimensions of the base plate arm substantially those of a sole of the boot. In its central portion, it is equipped wit a circular orifice 20 of approximately 8 to 10 centimeters (cm) in diameter. The orifice is demarcated by a peripheral and circular edge 21 of a special shape, comprising more specifically, a peripheral surface portion 200 having a substantially conical shape; or in other words, a portion whose surface is shaped like a ring that is progressively tapered upwardly.

In a complementary manner, the device comprises a central disc 3 having a contour that slightly exceeds the circular orifice 20. It is in turn equipped with a peripheral edge 30 having a surface portion 300 of a substantially complementary shape as compared to the shape of the surface portion 200 of the edge of the orifice 20, as can be seen in FIGS. 3 and 4. As such, it is a surface portion of a substantially conical shape whose slope is substantially equal to the slope of portion 200.

The expression substantially conical surface denotes a surface whose profile is globally inclined to form a sliding ramp, but which is not necessarily rectilinear. Indeed, it can have a concave profile, or inversely, a convex profile, without in any way leaving the scope of the instant invention.

The surface portions 200, 300 arm adapted to come into contact with one another to form a cone-upon-cone nesting of the disc in the orifice of the base plate. Such a nesting has the advantage, among others, of enabling the automatic centering of the disc in the orifice.

The central disc 3 is affixed to the plate by anchoring members 4 such as screws 40, 41, 42, 43 that pass through the holes distributed along the central disc. In the example illustrated, there are four screws and these are located at the four corners of a square 400 and spaced at 4 cm so as to comply with the most common prevalent norm.

Preferably, according to the invention, the surface portions 200, 300 in contact with one another are provided to be smooth so as to favor their sliding upon one another both during a rotational displacement of the base plate with respect to the central disc and during a sliding in a radial direction so as to achieve an off-centered position for the disc relative to the orifice, or inversely, so to regain the centered position.

Although it is not preferred, only one surface portion may be designed to be smooth, whereas the other has a rough or striated surface state. In this case, the smooth surface portion acts as the ramp to enable the sliding of the other surface thereupon.

As can be seen in FIG. 5, the device comprises a rotational stop arrangement for the base plate 2 with respect to the central disc 3, that is constituted by the meshing of a series of sections 310 positioned along the periphery of the edge 30 of the disc, in engagement with an engagement mechanism 22 occupying a limited art portion and comprising projecting elements 220, 221, 222 positioned along the base plate 2. The number of projecting elements may vary in order to ensure an adequate retention during rotation, with one such element being the minimum. For the correct functioning of the invention, it is important that the length of the arc portion formed by the occupation of the engagement mechanisms be short, not exceeding approximately 90 degrees, and preferably being less than 20 degrees, so as to allow an easy disengagement of the stop device. Naturally, the correct arc length depends on the geometry of the meshing, which can be more or less, (striations, serrations etc.), or on the materials used whose friction coefficient can be stronger or weaker; this enables one to reach a compromise between an adequate blocking of the plate during rotation and ease of disengagement of the stop arrangement during adjustment.

The serrations can be replaced by striations or by alveoli having varying shapes and sizes without, however, leaving the scope of the instant invention.

In the example described, the peripheral edge 30 of the central disc comprises an upper lip 330 bearing the series of serrations 310. This lip radially extends the surface portion 300 and takes support on a flat annular edge 230 of the edge 21 of the orifice of the base plate when the disc is in the nested position in the orifice, the edge 230 bearing the fixed engagement mechanism 22.

The projecting elements 220, 221, 222 are constituted of pions that are oriented vertically and housed in the edge 230 of the plate, and they cooperate with the series of serrations 310 equipping the periphery of lip 330 of the disc.

Figure 6:
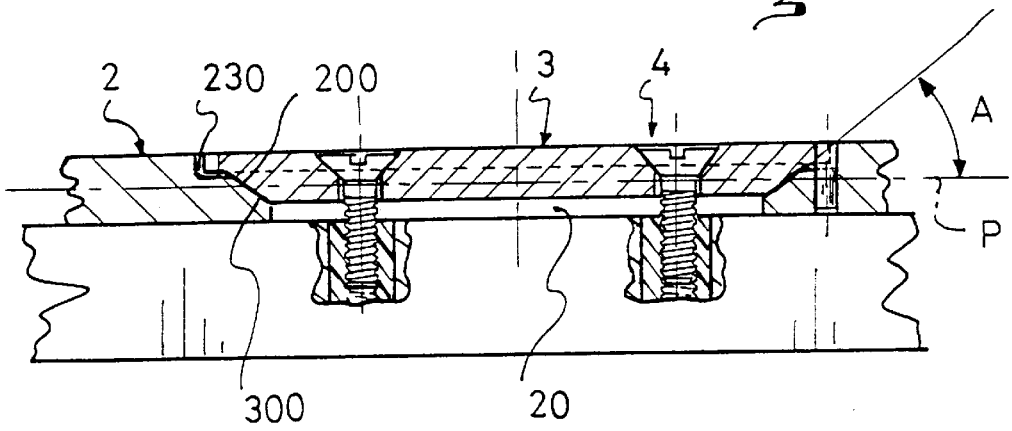
FIG. 6 is a sectional view taken along line VI—VI of FIG. 5 in the tightened position of the disc, and thus the blocked position of the device on the board.

The functioning of the invention will be described with reference to FIGS. 5 through 7. FIGS. 5 and 6 show the device in which the base plate is in a blocked position with respect to the disc. In order to tighten the disc by the anchoring screws 4, a substantial pressure is exerted on the surface portion 200 of the edge of the orifice, and this maintains the plate against the board. For a correct functioning, there must be a clearance between the lower surface of the disc and the surface of the board, in order to control the intensity of tightening. In this configuration, the disc 3 is perfectly nested in the orifice 20 and the stop device is an engagement position, such that the rotation of plate 2 becomes impossible.

Figure 7:
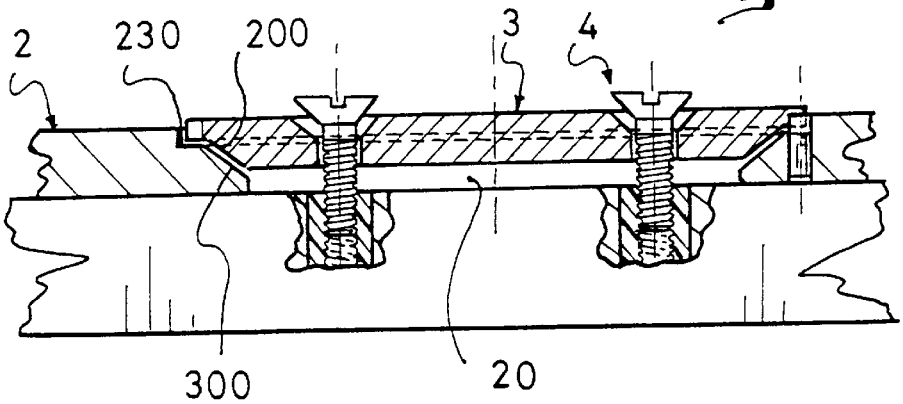
FIG. 7 is a sectional view similar to FIG. 6, wherein the disc is in a partially loosened position.

In order to obtain the rotational adjustment of the base plate, one needs to loosen the anchoring screws 4 by only a few revolutions so as to allow a slight vertical clearance for the disc, as is shown in FIG. 7. In this case, the rotation of the plate is still disallowed due to the fact that the disc remains nested in the orifice of the plate by its own weight.

Figure 8:
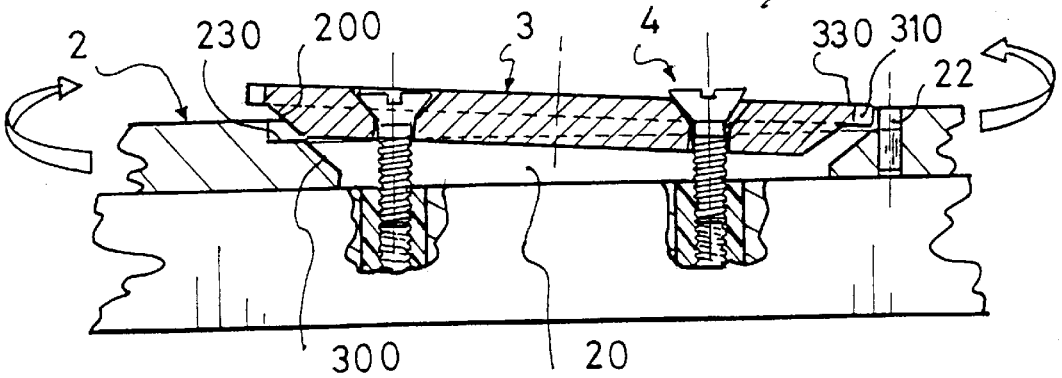
FIG. 8 is a sectional view similar to FIG. 6 showing the angular adjustment position of the base plate of the device according to the invention.

In order to obtain the rotational disengagement of the stop device, the disc need only be inclined by raising the disc from the opposite side via the stop device, as is shown in FIG. 8, or in FIG. 5 in dotted an dashed lines. The upper lip 330 that comprises the sensations 310 gets distanced from the projecting elements 22 of the plate. In this configuration, the plate may be rotationally displaced in the direction desired and at the angular value desired.

In order to block the disc, the retightening operation of the screws needs to be undertaken, and the disc regains its centered position in the orifice, and blocks the base plate in its new position on the board.

Preferably, the surface portions 200, 300 that are in contact with one another have a slope A with respect to the general plane P of the base plate, the slope being comprised between 25 and 45 degrees, and preferably comprised between 30 and 35 degrees (inclusive of the limit values). The choice of these values is linked to the need of ensuring the automatic centering of the disc so as to facilitate its positioning, a nesting that has some resistance to rotation in the tightening position of the plate as well as a nesting especially allows a radial sliding so as to encourage off-centering during the adjustment operation.

Figure 9:
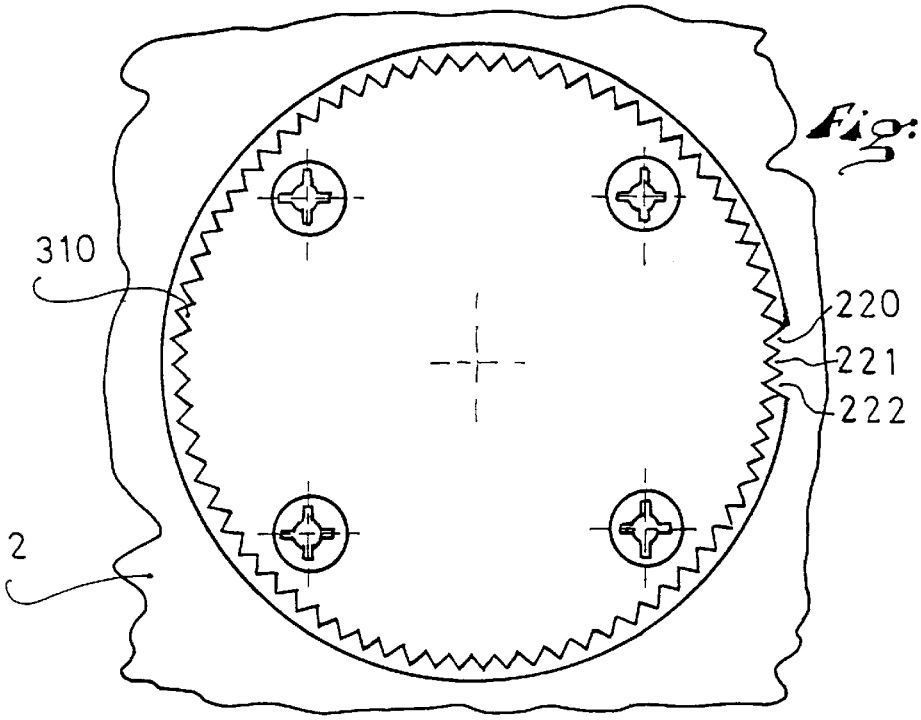
FIG. 9 is a partial, top view according to a variation of the invention.

FIG. 9 illustrates a different embodiment of the stop device wherein the projecting elements 220, 221, 222 are serrations whose shape complements the serrations present on the periphery of the disc. The shape of these serrations, for example, is like that of a saw and two adjacent serrations are separated by a space having a complementary shape. The advantage of such a shape for the serrations is that they are easy to disengage and reengage during the recentering of the disc.

Figure 10:
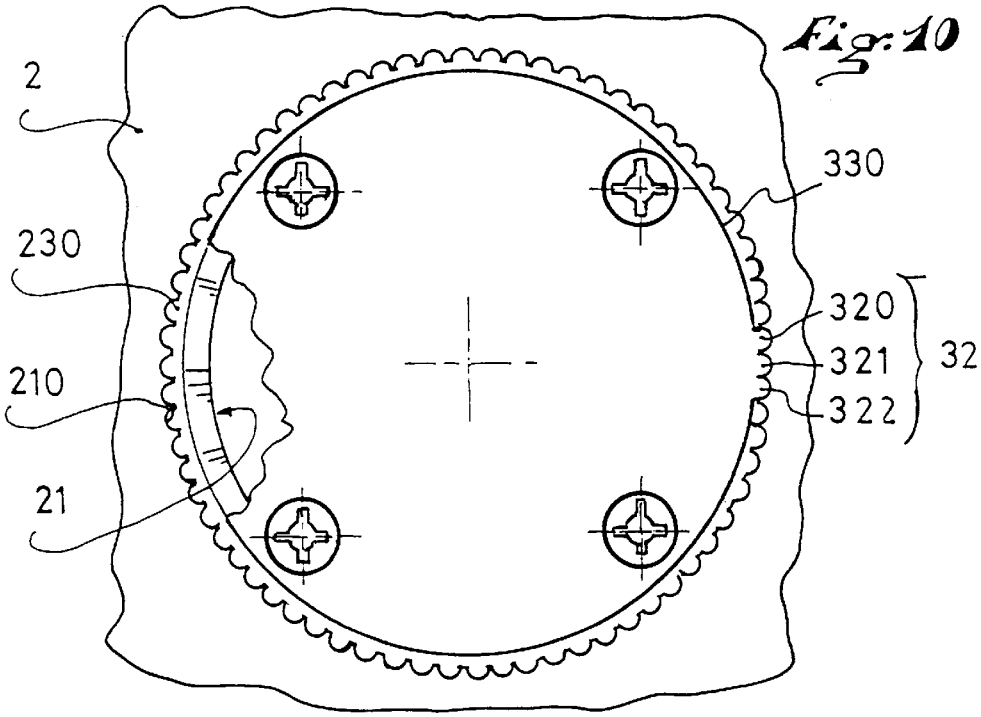
FIG. 10 is a partial, top view according to another variation of the invention.

FIG. 10 shows another variation wherein the rotational stop device is formed by the meshing of a series of serrations 210 positioned along the periphery of the edge 21 of the base plate, and is in engagement with an engagement mechanism 32 comprising several projecting elements 320, 321, 322 positioned along the edge of the disc. In this case, the upper lip 330 comprises the engagement mechanism 32 in the form of three serrations 320, 321, 322, for example, the remainder of the periphery of the disc being devoid of any engagement mechanism. The lip takes support on the annular edge 230 of the plate which comprises a series of serrations 210 occupying the entire circumference of the edge of the orifice. The serrations of the stop arrangement could be replaced by other equivalent retention elements such as striations for example. Similarly, the engagement mechanism 32 borne by the disc could be simply constituted by a single projecting element for example, without however, leaving the scope of the invention.

Figure 11:
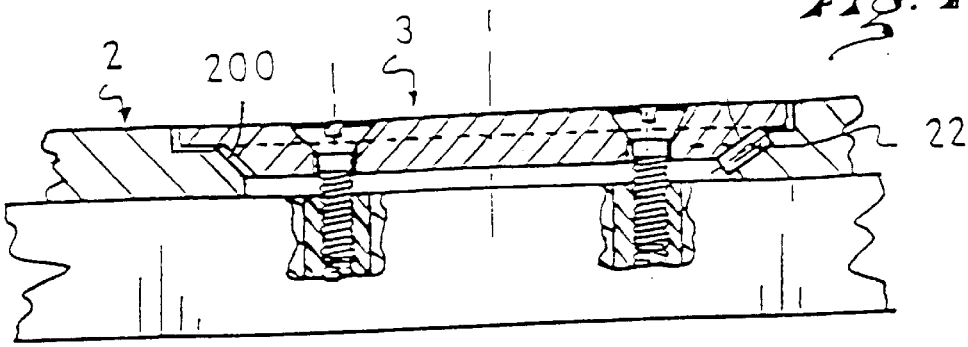
FIG. 11 is a sectional view similar to FIG. 6 according to another variation of the invention.
Figure 12:
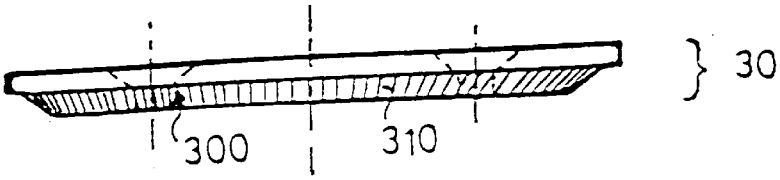
FIG. 12 is a side view of the central disc alone according to the variation of FIG. 11.

FIGS. 11 and 12 illustrate a variation of the invention in which the rotational stop device of the base plate 2 with respect to the disc 3 comprises a series of striations 310 equipping the inclined surface portion 300 of edge 30 of the disc, that come into contact with the surface portion 200 of edge 20 of the base plate. The stop arrangement also comprises at least one projecting engagement mechanism 22 constituted of at least one pion, for example, positioned in an inclined manner surface portion 200 of the edge of the base plate. As in the previous examples, it is important that engagement mechanism only occupy a limited portion of the arc of the edge of the base plate. This is done so as to encourage the lateral disengagement of the plate with respect to the disc, preferably from the opposite side of the disc.

However, it can be envisioned that two engagement mechanisms are located in a diametrically opposing manner along a certain direction on the edge of the disc, so as to ensure a better rotational blocking of the base plate, whilst also ensuring the disengagement, after partial unscrewing of the anchoring screws, in a radial direction, perpendicular to the direction connecting the opposing engagement mechanism.

In order to facilitate the disengagement, a certain clearance is provided between the lower annular edge of the disc and the upper annular edge of the base plate.

Figure 13:
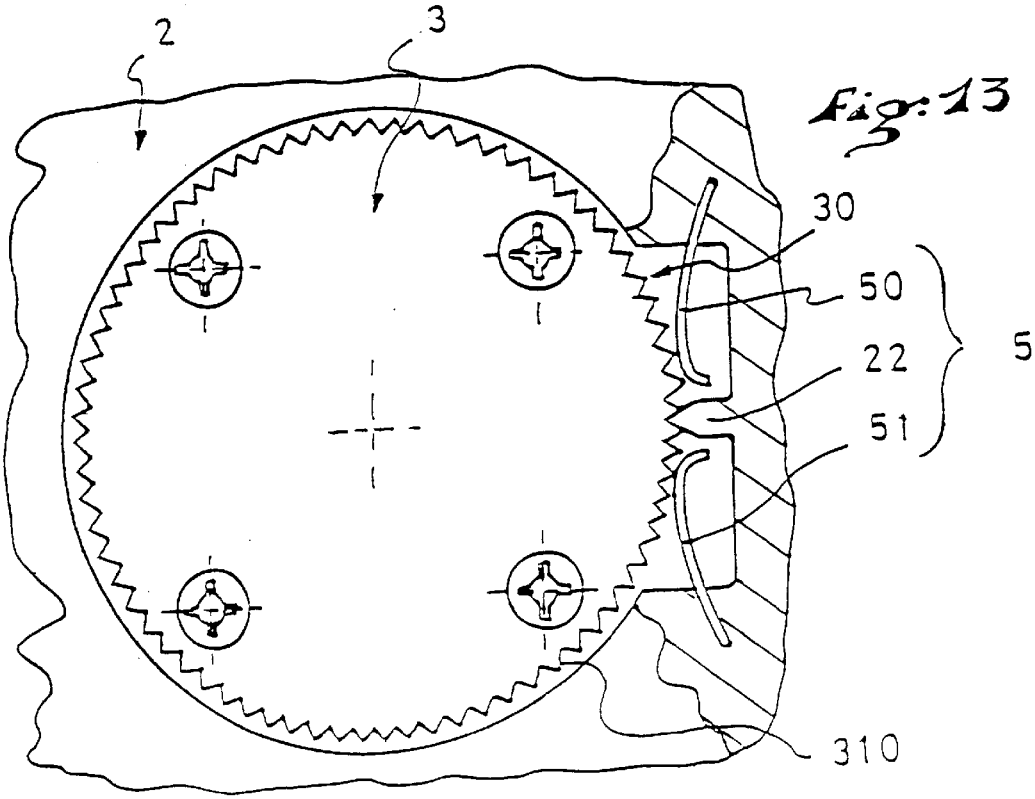
FIG. 13 is a view similar to FIG. 5 according to another variation of the invention.

As has been shown in the embodiment of FIG. 13, provision can also be made to integrate an elastic member into the device, such means acting horizontally on the disc to facilitate the disengagement of the stop device. The elastic mechanism 5 comprises, for example, two spring elements 50, 51 located on either side of the engagement mechanism 22, and that exert a thrust against the edge 30 of the disc. The spring elements 50, 51 are, for example, elements of the type having a metal spring rod. These could also be replaced by elastomer pads or any other equivalent means. When the screws are partially loosened, the force of the spring elements tends to displace the disc to the side with respect to the base plate, by sliding on the ramp formed by the surface portions that are in contact; the engagement mechanism 22 is thus disengaged from the striations 310 present on the edge of the disc. Thus, rotational adjustment becomes possible. In order to reposition the disc in the housing of the plate, one needs to only apply a counter pressure on the spring elements by thrusting the disc laterally in the direction of these elastic elements.

FIGS. 14 and 15 represent another possible, embodiment of the invention. In this particular case, the disc 3A is rendered rotationally mobile and the base plate 2A is directly connected to the board via the anchoring arrangement 4. The affixing device 6 is directly mounted on the disc. In the example represented, these affixing device 6 is constituted of a front support element 60 and a rear support element 61 opposite the front support element. These support elements are shown as loops made of wires that are resistant to bending and torsion, and on which are slidably mounted the positioning elements of the boot 62, 63. These positioning elements are, on the one hand, a rear element 63 shaped like a stirrup in which the rear of a sole of a boot should get positioned, and a front element 62 shaped like a stirrup and comprising a latching lever 620, adapted to get engaged on the front edge of the sole of the boot.

In the same way as in the previous embodiments the disc 3A and the base plate 2A are in contact with one another along the respective surface portions 200, 300 that are inclined with respect to the horizontal reference plane so as to constitute a sliding ramp that encourages the off centering of the disc with respect to the base plate when the screws 4 that retain the base plate on the board are partially loosened. The disc has the same structure of striations on the truncated surface portion 300 as the disc of FIG. 12. Thus, the striations of the disc equip the entire periphery of the surface portion 300. Conversely, the edge of the orifice of the base plate 2A comprises an engagement mechanism shaped like an inclined pion 22, for example, that gets engaged in the striations of the disc when the screws 4 are tightened.

The component elements of the device according to the invention can be selected from among resistant materials, such as certain metals. They can be made of steel, aluminum, or certain metallic alloys. One can also use certain injected, preferably reinforced plastics, to obtain all or some of the elements of the device.

Other embodiments can be envisioned without, however, leaving the scope of the invention as defined by the following claims.

The instant application is based upon the French priority patent application No. 96 13157, filed on Oct. 25, 1996, the disclosure of which is hereby expressly incorporated by reference thereto, and the priority of which is hereby claimed under 35 USC 119.

What is claimed is:

1. A device for adjusting the position of a binding on a glide board, especially a snowboard, comprising:

a base plate equipped with a circular orifice, an edge of the orifice comprising a first peripheral surface portion;

a central disc having a portion with a diameter that exceeds that of said circular orifice and comprising a peripheral edge that has a second surface portion adapted to come into contact with the first surface portion when the disc becomes nested in the orifice of the base plate;

an anchoring system of the central disc or, respectively, of said base plate for connection on the board, that can be actuated by tightening so as to retain a firm contact between the surface portions without any possibility of rotational movement of the base plate with respect to the disc or, respectively, of the central disc with respect to said base plate;

wherein at least one of said surface portions constitutes a sliding ramp for the other surface portion, and wherein the device comprises, in addition, a system that stops rotation of the base plate with respect to the central disc or, respectively, of the central disc with respect to said base plate, in an engagement position when the anchoring system is actuated by tightening, and is able to be disengaged by the sliding of said surface portions on the ramp formed by the other, and the off-centering of the central disc with respect to the orifice of the plate when the anchoring arrangement is only partially loosened, thus allowing a rotational movement of the base plate with respect to the central disc or, respectively, of the central disc with respect to said base plate, wherein the rotational stop system for the base plate on the board is formed by the meshing of a series of serrations or striations positioned along the entire periphery of edge of the disc or, respectively, along the periphery of edge of plate, in engagement with at least one engagement mechanism occupying a small arc portion, comprising at least one projecting element immovably fixed on the base plate or, respectively, on the edge of the disc the arc portion other than the engagement portion being smooth.

2. A device for adjusting the position of a binding on a glide board as defined by claim 1, wherein the two surface portions have a complementary substantially conical shape.

3. A device for adjusting the position of a binding on a glide board as defined by claim 1, wherein the anchoring system comprises of several screws passing through holes distributed along the central disc and adapted to get anchored in the glide board, the partial loosening of the screws allowing an off-centering of the disc with respect to the orifice of the base plate by the lateral displacement of the base plate causing a forced inclination of the central disc.

4. A device for adjusting the position of a binding on a glide board as defined by claim 1, wherein the surface portions that are in contact on one another have a slope with respect to the general plane of the base plate, such slope being comprised between 25 and 45 degrees, inclusive of the limit values.

5. A device for adjusting the position of a binding on a glide board as defined by claim 1, wherein the peripheral edge of the central disc comprises an upper lip bearing said series of serrations or striations or, respectively, said engagement mechanism, said lip radially extending the surface portion and taking support on an annular edge of the edge of the orifice of the base plate when the disc is in the nested position in the orifice, said edge bearing said engagement mechanism or, respectively, said series of serrations or striations.

6. A device for adjusting the position of a binding on a glide board as defined by claim 5, wherein the projecting element(s) of the engagement mechanism is (are) constituted of pin(s) oriented vertically and housed in said edge of the plate, said pin(s) cooperating with a series of serrations equipping the periphery of said lip of the disc.

7. A device for adjusting the position of a binding on a glide board as defined by claim 1, wherein the rotational stop device for the base plate with respect to the disc comprises a series of striations equipping the inclined surface portion of edge of the disc which comes into contact with the surface portion of edge of the base plate, said stop device also comprising at least one projecting engagement mechanism positioned in an inclined manner on the surface portion of the edge of the base plate.

8. A device for adjusting the position of a binding on a glide board as defined by claim 1, wherein the base plate comprises an elastic member that exerts a thrust against the edge of the disc so as to encourage the rotational disengagement of the stop device.

9. A device for adjusting the position of a binding on a glide board as defined by claim 8, wherein the elastic member is constituted of two spring elements of a metal spring rod type, located on either side of the engagement mechanism.

10. The device of claim 4 wherein the slope comprises between 30 and 35 degrees inclusive of the limit values.

* * * * *